US009668043B2

(12) United States Patent
Paschel et al.

(10) Patent No.: US 9,668,043 B2
(45) Date of Patent: May 30, 2017

(54) ELASTOMERIC COMPONENT FOR EARBUD HEADPHONES AND HEADPHONES INCLUDING SUCH ELASTOMERIC COMPONENTS

(71) Applicant: Skullcandy, Inc., Park City, UT (US)

(72) Inventors: Sam Paschel, Park City, UT (US); Andrew Pierce, Park City, UT (US); Joshua B. Poulsen, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 14/796,855

(22) Filed: Jul. 10, 2015

(65) Prior Publication Data

US 2016/0014498 A1 Jan. 14, 2016

Related U.S. Application Data

(60) Provisional application No. 62/024,353, filed on Jul. 14, 2014.

(51) Int. Cl.
*H04R 25/00* (2006.01)
*H04R 1/10* (2006.01)

(52) U.S. Cl.
CPC ..... *H04R 1/1091* (2013.01); *H04R 1/1016* (2013.01); *H04R 1/1066* (2013.01); *H04R 25/652* (2013.01); *H04R 2201/105* (2013.01)

(58) Field of Classification Search
CPC .. H04R 1/1016; H04R 25/652; H04R 25/656; H04R 25/658; H04R 1/1058
(Continued)

(56) References Cited

U.S. PATENT DOCUMENTS 5,449,865 A 9/1995 Desnick et al.
D624,057 S 9/2010 Kelly et al.
(Continued)

FOREIGN PATENT DOCUMENTS

EP 2107829 A2 10/2009
WO 2010151492 A1 12/2010
WO 2012024656 A2 2/2012

OTHER PUBLICATIONS

European Search Report, European Application No. 15176312.5, Nov. 26, 2015, eight (8) pages.

*Primary Examiner* — Paul S Kim
*Assistant Examiner* — Norman Yu
(74) *Attorney, Agent, or Firm* — TraskBritt

(57) ABSTRACT

An elastomeric component for use with an earbud headphone and for positioning within an auditory canal of an ear includes a distal end configured for insertion within an external portion of the auditory canal and an at least substantially hollow stem region extending proximally from the distal end. The hollow stem may include at least one connection feature configured to interface with another component of an earbud headphone to removably retain the elastomeric component thereon. The elastomeric component may also include an outer portion extending proximally from the distal end and at least substantially surrounding at least a portion of the stem region. The outer portion may include an outer surface having an at least substantially circular cross-sectional shape in a plane perpendicular to a central axis of the elastomeric component. Earbud headphones may include such elastomeric components.

14 Claims, 2 Drawing Sheets

(58) Field of Classification Search
USPC ..... 381/380, 328, 330, 74; 181/131, 135
See application file for complete search history.

(56) References Cited

U.S. PATENT DOCUMENTS

| | | | | |
|---|---|---|---|---|
| D656,129 | S | 3/2012 | Kelly et al. | |
| D673,140 | S | 12/2012 | Kelly et al. | |
| D674,376 | S | 1/2013 | Kelly et al. | |
| 8,457,557 | B2 | 6/2013 | Alden | |
| D685,767 | S | 7/2013 | Kelly et al. | |
| 8,515,115 | B2 | 8/2013 | Kelly et al. | |
| D701,196 | S | 3/2014 | Kelly et al. | |
| D701,197 | S | 3/2014 | Kelly et al. | |
| D728,533 | S | 5/2015 | Poulsen et al. | |
| 9,055,365 | B2 | 6/2015 | Kelly et al. | |
| 2008/0187161 | A1* | 8/2008 | Tiemens | B29C 44/1214 381/380 |
| 2009/0034775 | A1* | 2/2009 | Burton | H04R 1/1016 381/380 |
| 2012/0082336 | A1* | 4/2012 | Wubker | H04R 25/654 381/380 |
| 2013/0336514 | A1 | 12/2013 | Kelly et al. | |
| 2014/0138179 | A1* | 5/2014 | Burton | H04R 1/1016 181/135 |
| 2014/0270230 | A1 | 9/2014 | Oishi et al. | |

* cited by examiner

ELASTOMERIC COMPONENT FOR EARBUD HEADPHONES AND HEADPHONES INCLUDING SUCH ELASTOMERIC COMPONENTS

CROSS-REFERENCE TO RELATED APPLICATION

This application claims the benefit of U.S. Provisional Patent Application Ser. No. 62/024,353, filed Jul. 14, 2014, the disclosure of which is hereby incorporated herein in its entirety by this reference.

TECHNICAL FIELD

The present disclosure relates generally to earbud headphones, and more specifically to elastomeric components of earbud headphones that are positioned within the external auditory canal of the ear when the earbud headphones are used by a person.

BACKGROUND

Earbud headphones are used to convert an electronic signal into an audible sound, which is transmitted to the ear of a person using the earbud headphones. Earbud headphones are used in conjunction with many different types of electronic devices, such as media players, hearing aids, cellular telephones, televisions, computers, etc. In contrast to what are referred to in the industry as "on-ear" headphones and "over-ear" headphones, earbud headphones are relatively small headphones that rest within the concha of the outer ear and are often referred to as "in-ear" headphones. Earbud headphones are retained in place by the cooperation and mechanical interference between the earbud headphone and the ear of the user. Some earbud headphones include a portion that is sized and configured to extend from a main body of the headphone into the external auditory canal of the ear.

Earbud headphones are popular among users because they are generally relatively small and portable. Moreover, when a user is participating in various activities, earbud headphones interfere to a much lesser extent with the other accessories or equipment of the user, such as helmets, goggles, hats, and headbands compared to on-ear and over-ear headphones, which often include a headband or other connecting structure (in addition to wiring) extending around the head of the user between each headphone.

As mentioned above, earbud headphones are typically designed to be held in place within a user's ear by sizing and configuring the earbud headphone to cooperate with the anatomy of the ear such that physical interference between the headphone and the ear retains the headphone in place during use. As the size of the ear varies from person to person, earbud headphones may not fit comfortably in the ear of all potential users. For some users, the size of the ear may be too small to allow the earbud headphone to be worn and used comfortably, especially for extended periods of time. For other users, the size of the ear may be too large to securely retain the earbud headphone in position within the ear during use. Thus, for some users, earbud headphones are not comfortable, and for other users, earbud headphones cannot be securely retained within the ear during use. Furthermore, earbud headphones are often worn during physical activity, such as sporting activities and exercise.

Extensive movement of the person during use, and moisture originating from rain, snow, or perspiration can facilitate movement of the headphone out of the desired position in the ear of the user.

BRIEF SUMMARY

In some embodiments, the present disclosure includes an elastomeric component for use with an earbud headphone and for positioning within an auditory canal of an ear. The elastomeric component includes a distal end configured for insertion within an external portion of the auditory canal and an at least substantially hollow stem region extending proximally from the distal end. The hollow stem includes at least one connection feature configured to interface with another component of an earbud headphone to removably retain the elastomeric component thereon. The elastomeric component also includes an outer portion extending proximally from the distal end and at least substantially surrounding at least a portion of the stem region, and the outer portion includes an outer surface having an at least substantially circular cross-sectional shape in a plane perpendicular to a central axis of the elastomeric component. The outer surface of the outer portion has a maximum diameter located a distance from the distal end along the central axis, the distance being between about fifty percent (50%) and about sixty percent (60%) of the maximum diameter. The outer surface of the outer portion has a diameter equal to or less than about seventy percent (70%) of the maximum diameter at all distances from the distal end along the central axis equal to or less than about twenty percent (20%) of the maximum diameter. The outer surface of the outer portion has a diameter equal to or less than about eighty-eight percent (88%) of the maximum diameter at all distances equal to or less than about thirty percent (30%) of the maximum diameter.

In other embodiments, the present disclosure includes an earbud headphone including a main body and an elastomeric component carried on the main body, the elastomeric component configured for positioning within an auditory canal of an ear, the elastomeric component removably attached to a main body of the earbud headphone. The elastomeric component includes a distal end configured for insertion within an external portion of the auditory canal and an at least substantially hollow stem region extending proximally from the distal end. The hollow stem includes at least one connection feature configured to interface with another component of an earbud headphone to removably retain the elastomeric component thereon. The elastomeric component includes an outer portion extending proximally from the distal end and at least substantially surrounding at least a portion of the stem region, the outer portion including an outer surface having an at least substantially circular cross-sectional shape in a plane perpendicular to a central axis of the elastomeric component. The outer surface of the outer portion has a maximum diameter located a distance from the distal end along the central axis, the distance being between about fifty percent (50%) and about sixty percent (60%) of the maximum diameter. The outer surface of the outer portion has a diameter equal to or less than about seventy percent (70%) of the maximum outside diameter at all distances from the distal end along the central axis equal to or less than about twenty percent (20%) of the maximum diameter. The outer surface of the outer portion has a diameter equal to or less than about eighty-eight percent (88%) of the maximum outside diameter at all distances equal to or less than about thirty percent (30%) of the maximum outside diameter.

In yet other embodiments, the present disclosure includes an elastomeric component for use with an earbud headphone and for positioning within an auditory canal of an ear, the elastomeric component including a distal end configured for insertion within an external portion of the auditory canal, an at least substantially hollow stem region extending proximally from the distal end, the hollow stem including at least one connection feature configured to interface with another component of an earbud headphone to removably retain the elastomeric component thereon, and an outer portion extending proximally from the distal end and at least substantially surrounding at least a portion of the stem region. The outer portion includes an outer surface having an at least substantially circular cross-sectional shape in a plane perpendicular to a central axis of the elastomeric component. The outer surface of the outer portion has a maximum diameter located a distance from the distal end along the central axis, the distance being between about fifty percent (50%) and about sixty percent (60%) of the maximum diameter. The outer surface of the outer portion has a diameter equal between about fifty-eight percent (58%) and about sixty-seven percent (67%) of the maximum outside diameter at all distances from the distal end along the central axis equal to or less than about twenty percent (20%) of the maximum diameter. The outer surface of the outer portion has a diameter equal to between about sixty-seven percent (67%) and about eighty-eight percent (88%) of the maximum outside diameter at all distances from the distal end along the central axis equal to between about twenty percent (20%) and about thirty percent (30%) of the maximum outside diameter. The outer surface of the outer portion has a cross-sectional shape in a plane comprising the central axis of the elastomeric component, the cross-sectional shape including a concave portion and a convex portion located distally from the concave portion, wherein the concave portion extends through all distances from the distal end along the central axis greater than about twenty percent (20%) of the maximum diameter and less than about thirty percent (30%) of the maximum outside diameter.

DETAILED DESCRIPTION

The illustrations presented herein are not meant to be actual views of any particular headphone or component thereof, but are merely idealized representations employed to describe various embodiments of the disclosure.

Figure 1:
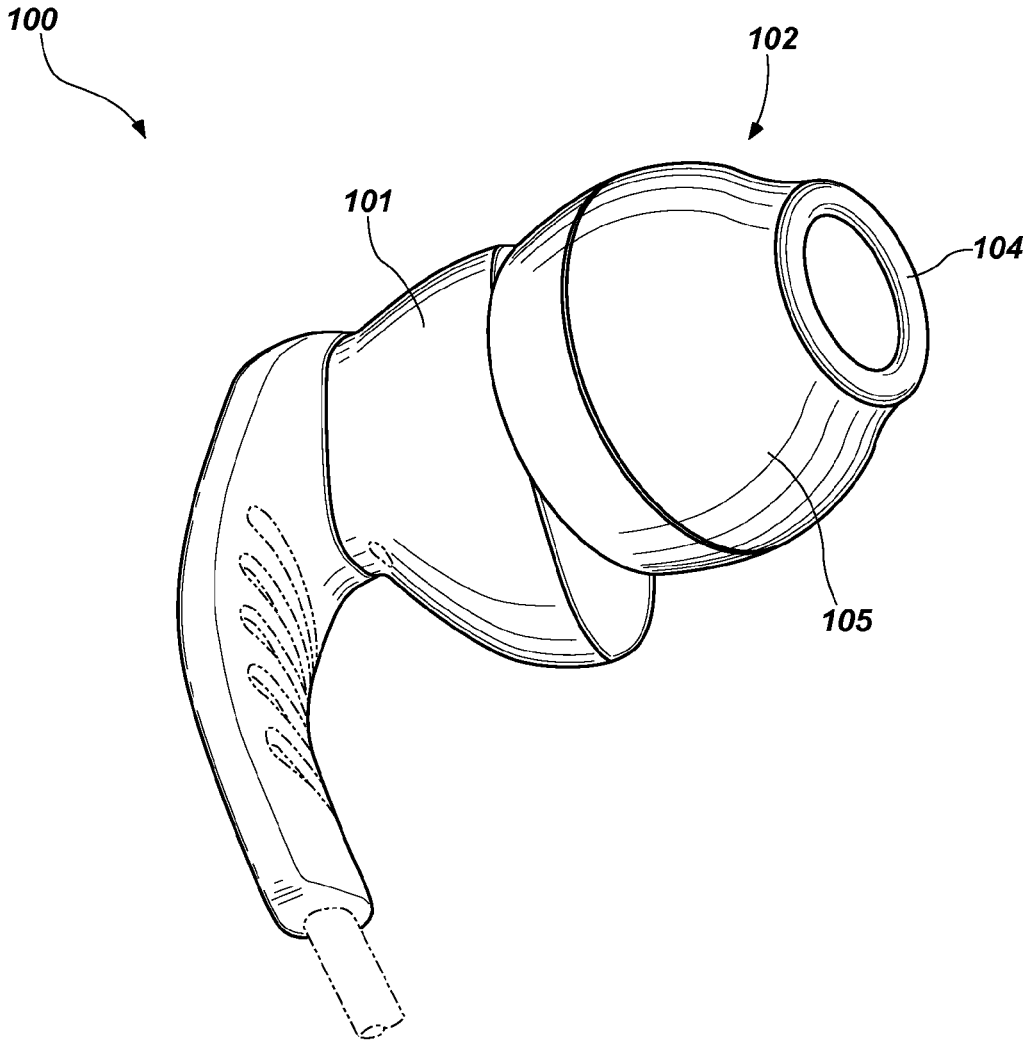
FIG. 1 is a perspective view of an earbud headphone including an elastomeric component according to the disclosure.

FIG. 1 is a perspective view of an earbud headphone 100 including a main body 101 and an elastomeric component 102. The main body 101 may include an electromechanical transducer (which may be referred to in the art as a "driver") configured to convert an electrical signal into sound pressure waves audible to a listener. The elastomeric component 102 includes a distal nozzle region 104 configured for insertion into an external auditory canal of a human ear (not shown). An outer surface 105 of the elastomeric component 102 may be configured to interface with an inner surface of the auditory canal to retain the elastomeric component 102 and the earbud headphone 100 within the ear while the earbud headphone 100 is in use. The elastomeric component 102 may have a shape, a surface texture, and/or a material composition that improve retention of the earbud headphone 100 in the auditory canal of a user. Furthermore, the retention of the earbud headphone 100 in the auditory canal of a user when moisture is present due to, for example, perspiration or humidity, may be improved relative to previously known earbud headphones due to the configuration and composition of the elastomeric component 102.

Figure 2:
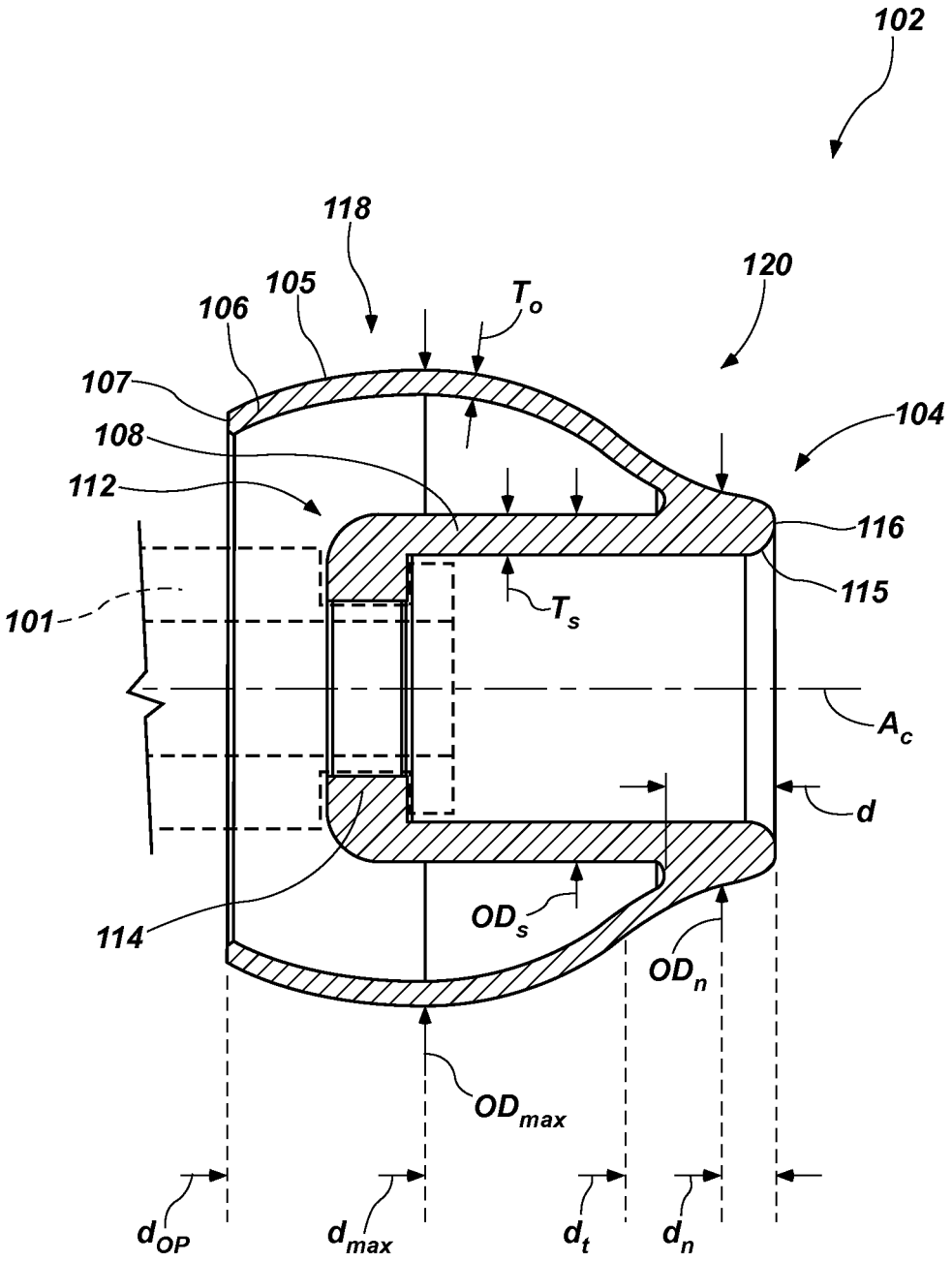
FIG. 2 is a cross-sectional side view of the elastomeric component of FIG. 1.

FIG. 2 is a cross-sectional side view of the elastomeric component 102 of FIG. 1. The elastomeric component 102 includes a distal nozzle region 104 for insertion into an auditory canal and an outer portion 106 configured to at least partially conform to the inner surface of the auditory canal. The distal nozzle region 104 may have a rounded leading surface 115 and a distal end 116. As a non-limiting example, the rounded leading surface 115 of the distal nozzle region 104 may have a radius of about 1 millimeter. The outer portion 106 may be configured to contact and grip an inner surface of the auditory canal. The elastomeric component 102 may include a substantially hollow stem region 108 extending proximally from the distal nozzle region 104. The stem region 108 may include a connection feature 112 configured to interface with the body 101 of the earbud headphone 100 (FIG. 1). For example, the connection feature 112 may include a flange 114 sized and configured to interface with a grooved extension of the earbud headphone body 101 (shown in broken lines). The stem region 108 may have an outside diameter $OD_s$ of, for example, between about 6 millimeters and about 7 millimeters. As a non-limiting example, in the embodiment of FIG. 2, the stem region 108 may have an outside diameter $OD_s$ with a dimension of about 6.52 millimeters.

At least some elements of the elastomeric component 102 may have a substantially circular cross-sectional shape in a plane perpendicular to a central axis $A_c$ of the elastomeric component 102. For example, the outer portion 106 may have a substantially circular cross-sectional shape in a plane perpendicular to a central axis $A_c$ of the elastomeric component 102. In some embodiments, the stem region 108 may also have a substantially circular cross-section in a plane perpendicular to the central axis $A_c$.

As shown in FIG. 2, the outer portion 106 and the stem region 108 may be formed integrally near the distal nozzle region 104. The outer portion 106 may extend proximally from and at least substantially circumferentially surround the stem region 108 proximate the distal nozzle region 104 and proximal from the distal end 116 a distance d along the central axis $A_c$. The distance d may be, for example, between about 1 millimeter and 3 millimeters. More specifically, the distance d may be about 2 millimeters. As a non-limiting example, the distance d may be about 2.06 millimeters. The outer portion 106 may be substantially or completely radially unsupported at all distances greater than the distance d from the distal end 116 along the central axis $A_c$ to allow the outer portion 106 to substantially conform to the inner surface of the auditory canal of the user's ear. The outer portion 106 may have an open end 107, which may extend beyond the connection feature 112 along the central axis $A_c$.

The outer surface 105 of the outer portion 106 may have a maximum diameter $OD_{max}$. In some embodiments, the maximum diameter $OD_{max}$ may be between about 10 millimeters and about 14 millimeters. More specifically, the maximum diameter $OD_{max}$ may be between about 11.5 millimeters and about 12.5 millimeters. In the embodiment shown in FIG. 2, the maximum diameter $OD_{max}$ may be about twelve (12) millimeters. For example, the maximum diameter $OD_{max}$ may be about 11.98 millimeters. The maximum diameter $OD_{max}$ may be located a distance $d_{max}$ from the distal end 116 along the central axis $A_c$. The distance $d_{max}$ may be equal to between about fifty percent (50%) and about sixty percent (60%) of the maximum diameter $OD_{max}$. In the embodiment shown in FIG. 2, the maximum diameter $OD_{max}$ may be located a distance $d_{max}$ along the central axis $A_c$ from the distal end 116 equal to about 54% of the maximum diameter $OD_{max}$. Thus, in an embodiment in which the maximum diameter $OD_{max}$ is about 12 millimeters, the distance $d_{max}$ may be about 6.5 millimeters.

The outer portion 106 may define an outer surface 105 with a generally arcuate shape in the cross-section of FIG. 2, i.e., a cross-sectional plane comprising the central axis $A_c$. For example, the cross-sectional shape of the outer surface 105 may comprise convex shapes, concave shapes, or combinations thereof. In contrast to previously known devices, which may be substantially convex over an entire outer surface, the outer surface 105 according to the present disclosure may include a generally convex portion 118 and a portion that does not form a continuously convex outer surface in conjunction with the generally convex portion 118. For example, the outer surface 105 may include a generally concave portion 120 located on the outer surface 105 between the generally convex portion 118 and the location at which the outer portion 106 joins the stem region 108. In other words, the generally convex portion 118 is located distally from the generally concave portion 120 with respect to the location at which the outer portion 106 joins the stem region 108.

The generally concave portion 120 may be proximate the distal nozzle region 104, and the cross-sectional shape of the outer surface 105 may transition from the generally concave portion 120 to the generally convex portion 118 at a location a distance $d_t$ from the distal end 116 along the central axis $A_c$. The distance $d_t$ may be equal to about thirty percent (30%) of the maximum diameter $OD_{max}$. As a non-limiting example, in embodiments of in which the maximum diameter $OD_{max}$ is equal to about 12 millimeters, the distance $d_t$ may be equal to about 3.6 millimeters. The concave portion 120 of the outer surface 105 may extend at least through all distances from the distal end 116 along the central axis Ac greater than about twenty percent (20%) of the maximum diameter $OD_{max}$ and less than about thirty percent (30%) of the maximum diameter $OD_{max}$. Thus, in embodiments in which the maximum diameter $OD_{max}$ is equal to about 12 millimeters, the concave portion 120 may extend at least through all distances from the distal end 116 along the central axis $A_c$ equal to between about 2.4 millimeters and about 3.6 millimeters. In some embodiments, the maximum diameter $OD_{max}$ may be located in the convex portion 118 of the outer surface 105.

The outer surface 105 of the outer portion 106 may have a nozzle region diameter $OD_s$ equal to or less than about seventy percent (70%) of the maximum diameter at all distances from the distal end 116 along the central axis $A_c$ equal to or less than about twenty percent (20%) of the maximum diameter $OD_{max}$. More specifically, the nozzle region diameter $OD_s$ may be equal to between about fifty-eight percent (58%) and about sixty-seven percent (67%) of the maximum diameter $OD_{max}$ at all distances from the distal end 116 along the central axis $A_c$ equal to less than about twenty percent (20%) of the maximum diameter $OD_{max}$. In some embodiments, the nozzle outside diameter $OD_s$ may be defined at a location along the central axis $A_c$ within a distance of the distal end 116 equal to about 17% of the maximum outside diameter $OD_{max}$. As a non-limiting example, in an embodiment in which the maximum diameter $OD_{max}$ is about 12 millimeters, the nozzle region diameter $OD_s$ in the embodiment of FIG. 2 may be between about 7 millimeters and about 8 millimeters at all distances along the central axis $A_c$ within about 2 millimeters of the distal end 116.

The outer surface 105 of the outer portion 106 may have a diameter equal to or less than about eighty-eight percent (88%) of the maximum diameter $OD_{max}$ at all distances along the central axis $A_c$ from the distal end 116 equal to or less than about thirty percent (30%) of the maximum diameter $OD_{max}$. More specifically, the outer surface 105 may have a diameter equal to between about sixty-seven percent (67%) and about eighty-eight percent (88%) of the maximum diameter $OD_{max}$ at all distances from the distal end 116 along the central axis $A_c$ greater than about twenty percent (20%) and less than about thirty percent (30%) of the maximum diameter $OD_{max}$. As a non-limiting example, in an embodiment in which the maximum diameter $OD_{max}$ is equal to about 12 millimeters, the outer surface 105 may have a diameter of between about 8 millimeters and about 10.6 millimeters at all distances between about 2.4 millimeters and about 3.6 millimeters from the distal end 116 along the central axis $A_c$.

The wall thickness $T_o$ of the outer portion 106 may be chosen to enable the outer portion 106 to elastically deform as the outer portion 106 is inserted into the auditory canal of a person's ear. The outer portion 106 may have a wall thickness $T_o$ of, for example, between about 0.25 millimeters and about 0.75 millimeters. As a further non-limiting example, $T_o$ may be about 0.45 millimeters.

The stem region 108 may have a wall thickness $T_s$ greater than the wall thickness $T_o$ of the outer portion 106. For example, the wall thickness $T_s$ of the stem region 108 may be between about 0.5 and about 1 millimeter. As another non-limiting example, the wall thickness $T_s$ of the stem region 108 may be about 50% or more greater than the wall thickness $T_o$ of the outer portion 106. In the embodiment shown in FIG. 2, the wall thickness $T_s$ of the stem region 108 has a dimension of about 0.75 millimeters. The wall thickness $T_s$ of the stem region 108 may be chosen to enable the stem region 108 to substantially maintain shape when the distal nozzle region 104 is inserted into the auditory canal. In other words, the wall thickness $T_s$ of the stem region 108 may be chosen to prevent the stem region 108 from collapsing (e.g., buckling) when the distal nozzle region 104 is inserted into the auditory canal.

The outer portion 106 may extend from the distal end 116 in a proximal direction along the central axis $A_c$ of the elastomeric component 102 a distance $d_{OP}$ equal to about 75% or more of the maximum outside diameter $OD_{max}$. More specifically, the distance $d_{OP}$ may be about 85% of the maximum outside diameter $OD_{max}$. As a non-limiting example, in an embodiment in which the maximum diameter is equal to about 12 millimeters, the distance $d_{OP}$ may be about 10.2 millimeters.

The geometric configuration shown and described in connection with FIG. 2 may enable the elastomeric component 102 to fit comfortably and securely within the auditory canal of a person's ear. For example, because the cross-sectional area of a typical auditory canal entrance quickly decreases with increasing depth into the canal, the outside diameter of the elastomeric component 102 may be made relatively small proximate the distal nozzle region 104 to enable the elastomeric component 102 to fit within the auditory canal without applying excessive pressure to the inner surface of the auditory canal. The outside diameter of the elastomeric component 102 may increase to a relatively larger diameter proximal from the distal nozzle region 104 to exert radial pressure on the wider portion of the entrance to the auditory canal to retain the elastomeric component 102 within the auditory canal and an associated earbud headphone 100 (FIG. 1) within the ear.

While many of the specific examples and dimensions described in connection with FIG. 2 are based on the elastomeric component 102 having a maximum diameter $OD_{max}$ of about 12 millimeters, it should be understood that different embodiments may have maximum diameters less than or greater than about 12 millimeters. In such embodiments, other dimensions of the elastomeric component 102 may be defined based on the particular maximum diameter of that embodiment according to the ranges of percentages and the specific percentages set forth above, relative to the maximum diameter. Thus, relatively larger or relatively smaller elastomeric components 102 may be provided to fit various ear sizes, while the relationships between the maximum diameter and other dimensions within a particular embodiment may remain substantially the same among different sized embodiments.

The elastomeric component 102 may comprise a flexible material such as natural rubber (e.g., latex) or synthetic rubber (e.g., silicone). The material may be chosen to enable the elastomeric component 102 to at least partially deform when inserted into the auditory canal. For example, in some embodiments, the outer portion 106 may elastically deform to substantially conform to the shape of the inner surface of the auditory canal. User comfort may thereby be enhanced, as a pressure applied to the inner surface of the auditory canal by the elastomeric component 102 is distributed substantially evenly over the area of the inner surface contacted by the elastomeric component 102. Furthermore, elastic deformation of the outer portion 106 may form a substantially airtight seal between the outer portion 106 and the inner surface of the auditory canal, which may enhance the sound quality perceived by the listener.

In some embodiments, the material of the elastomeric component may exhibit a hardness of between about 30 and about 50 on the Shore type A durometer scale. More specifically, in some embodiments, the elastomeric component may exhibit a Shore hardness of about 40 A. One non-limiting example of a suitable material is silicone rubber compound CHN-6300-U, available from Shin-Etsu Chemical Co., Ltd. of Tokyo, Japan. Other materials having desired characteristics may be used. For example, such desired characteristics may include, in addition to the hardness specified above, a Williams plasticity of about 148, a density at 23° C. of about 1.09 g/cm$^3$, a tensile strength of about 7.6 Mpa, an elongation at break of about 620%, a tear strength of about 10 kN/m, an elasticity of about 73%, and a compression set of about 21% at 180° C.*22 h.

The outer portion 106 may include a surface finish configured to facilitate retention of the elastomeric component 102 within an auditory canal of an ear. At least a portion of the outer surface 105 of the outer portion 106 may exhibit a specific surface roughness. For example, at least a portion of the outer surface 105 may exhibit a root mean square (RMS) surface roughness of between about 1 μm and about 30 μm. More specifically, at least a portion of the outer surface 105 of the outer portion 106 may exhibit between about 2 μm and about 20 μm RMS surface roughness. In the embodiment shown in FIG. 2, at least a portion of the outer surface 105 of the outer portion 106 may exhibit between about 3 μm and about 10 μm RMS surface roughness. The desired surface roughness may be achieved by, for example, providing at least a portion of an interior of a tooling component (e.g., a mold) used to form (e.g., by a molding process) the elastomeric component 102 with a texture that will impart to the outer surface 105 of the outer portion 106 of the elastomeric component 102 the desired surface finish.

The elastomeric component 102 may be formed as a single, unitary component by a process such as, e.g., injection molding. In other embodiments, the elastomeric component 102 may be made from multiple components affixed together to form the elastomeric component 102. For example, the elastomeric component 102 may be made from multiple components of similar or different materials and may be bonded together with, e.g., an adhesive.

Additional non-limiting example embodiments of the disclosure are set forth below.

Embodiment 1

An elastomeric component for use with an earbud headphone and for positioning within an auditory canal of an ear, the elastomeric component comprising: a distal end configured for insertion within an external portion of the auditory canal; an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein: the outer surface of the outer portion has a maximum diameter located a distance from the distal end along the central axis, the distance being between about fifty percent (50%) and about sixty percent (60%) of the maximum diameter; the outer surface of the outer portion has a diameter equal to or less than about seventy percent (70%) of the maximum diameter at all distances from the distal end along the central axis equal to or less than about twenty percent (20%) of the maximum diameter; and the outer surface of the outer portion has a diameter equal to or less than about eighty-eight percent (88%) of the maximum diameter at all distances equal to or less than about thirty percent (30%) of the maximum diameter.

Embodiment 2

The elastomeric component of Embodiment 1, wherein the maximum diameter is between about 11.5 millimeters and about 12.5 millimeters.

Embodiment 3

The elastomeric component of Embodiment 2, wherein the maximum diameter is about 12 millimeters.

Embodiment 4

The elastomeric component of any one of Embodiments 1 through 3, wherein the distance at which the maximum diameter is located from the distal end along the central axis of the elastomeric component is about fifty-four percent (54%) of the maximum diameter.

Embodiment 5

The elastomeric component of any one of Embodiments 1 through 4, wherein the outer surface of the outer portion has a diameter between about fifty-eight percent (58%) and about sixty-seven percent (67%) of the maximum diameter at all distances from the distal end along the central axis equal to or less than about twenty percent (20%) of the maximum diameter.

Embodiment 6

The elastomeric component of any one of Embodiments 1 through 5, wherein the outer surface of the outer portion has a diameter between about sixty-seven percent (67%) and about eighty-eight percent (88%) of the maximum diameter at all distances from the distal end along the central axis greater than about twenty percent (20%) of the maximum diameter and less than about thirty percent (30%) of the maximum outside diameter.

Embodiment 7

The elastomeric component of any one of Embodiments 1 through 6, wherein the outer surface of the outer portion has a cross-sectional shape in a plane comprising the central axis of the elastomeric component, the cross-sectional shape including a concave portion and a convex portion located distally from the concave portion, wherein the concave portion extends through all distances from the distal end along the central axis greater than about twenty percent (20%) of the maximum diameter and less than about thirty percent (30%) of the maximum outside diameter.

Embodiment 8

The elastomeric component of Embodiment 7, wherein the maximum diameter of the outer surface of the outer portion is located in the convex portion.

Embodiment 9

The elastomeric component of any one of Embodiments 1 through 8, wherein the elastomer component comprises a material having a Shore A durometer hardness of between about 30 and about 50.

Embodiment 10

The elastomeric component of Embodiment 9, wherein the elastomer component comprises a material having a Shore A durometer hardness of about 40.

Embodiment 11

The elastomeric component of any one of Embodiments 1 through 10, wherein the elastomer component comprises a silicone rubber material.

Embodiment 12

The elastomeric component of any one of Embodiments 1 through 11, wherein the outer surface of the outer portion has a root mean square (RMS) surface roughness of between about 1 μm and about 30 μm.

Embodiment 13

The elastomeric component of Embodiment 12, wherein the outer surface of the outer portion has an RMS surface roughness of between about 2 urn and about 20 μm.

Embodiment 14

The elastomeric component of Embodiment 13, wherein the outer surface of the outer portion has an RMS surface roughness of between about 3 μm and about 10 μm.

Embodiment 15

The elastomeric component of any one of Embodiments 1 through 14, wherein the at least substantially hollow stem region has a circular cross-sectional shape in a plane perpendicular to the central axis of the elastomeric component when the elastomeric component is not mounted to an earbud headphone.

Embodiment 16

An earbud headphone, comprising: a main body; and an elastomeric component carried on the main body, the elastomeric component configured for positioning within an auditory canal of an ear, the elastomeric component removably attached to a main body of the earbud headphone, the elastomeric component comprising: a distal end configured for insertion within an external portion of the auditory canal; an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein: the outer surface of the outer portion has a maximum diameter located a distance from the distal end along the central axis, the distance being between about fifty percent (50%) and about sixty percent (60%) of the maximum diameter; the outer surface of the outer portion has a diameter equal to or less than about seventy percent (70%) of the maximum outside diameter at all distances from the distal end along the central axis equal to or less than about twenty percent (20%) of the maximum diameter; and the outer surface of the outer portion has a diameter equal to or less than about eighty-eight percent (88%) of the maximum outside diameter at all distances equal to or less than about thirty percent (30%) of the maximum outside diameter.

Embodiment 17

An elastomeric component for use with an earbud headphone and for positioning within an auditory canal of an ear, the elastomeric component comprising: a distal end configured for insertion within an external portion of the auditory canal; an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein: the outer surface of the outer portion has a maximum diameter located a distance from the distal end along the central axis, the distance being between about fifty percent (50%) and about sixty percent (60%) of the maximum diameter; the outer surface of the outer portion has a diameter equal between about fifty-eight percent (58%) and about sixty-seven percent (67%) of the maximum outside diameter at all distances from the distal end along the central axis equal to or less than about twenty percent (20%) of the maximum diameter; the outer surface of the outer portion has a diameter equal to between about sixty-seven percent (67%) and about eighty-eight percent (88%) of the maximum outside diameter at all distances from the distal end along the central axis equal to between about twenty percent (20%) and about thirty percent (30%) of the maximum outside diameter; and the outer surface of the outer portion has a cross-sectional shape in a plane comprising the central axis of the elastomeric component, the cross-sectional shape including a concave portion and a convex portion located distally from the concave portion, wherein the concave portion extends through all distances from the distal end along the central axis greater than about twenty percent (20%) of the maximum diameter and less than about thirty percent (30%) of the maximum outside diameter.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of claimed invention, including legal equivalents. For example, any one or more features from one disclosed embodiment may be combined with any one or more features of another disclosed embodiment to provide additional embodiments of the present disclosure as contemplated by the inventors.

What is claimed is:

1. An elastomeric component for use with an earbud headphone and for positioning within an auditory canal of an ear, the elastomeric component comprising:

a distal end configured for insertion within an external portion of the auditory canal;

an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein:

the outer surface of the outer portion has a maximum diameter located a distance from the distal end along the central axis, the distance being between about fifty percent (50%) and about sixty percent (60%) of the maximum diameter; the outer surface of the outer portion has a diameter equal to or less than about seventy percent (70%) of the maximum diameter at all distances from the distal end along the central axis equal to or less than about twenty percent (20%) of the maximum diameter;

the outer surface of the outer portion has a diameter equal to or less than about eighty-eight percent (88%) of the maximum diameter at all distances equal to or less than about thirty percent (30%) of the maximum diameter;

a distance $d_{OP}$ is equal to between 75% and 85% of the maximum outside diameter $OD_{max}$;

the elastomeric component comprises a material having a hardness of between 30 and 50 on the Shore type A durometer scale; and the outer portion is configured to facilitate retention of the elastomeric component in the auditory canal and wherein:

at least a portion of the outer portion of the outer surface exhibits a root mean square ("RMS") surface roughness of 3 μm;

wherein the maximum diameter is between about 11.5 millimeters and about 12.5 millimeters.

2. The elastomeric component of claim 1, wherein the maximum diameter is about 12 millimeters.

3. The elastomeric component of claim 1, wherein the distance at which the maximum diameter is located from the distal end along the central axis of the elastomeric component is about fifty-four percent (54%) of the maximum diameter.

4. The elastomeric component of claim 1, wherein the outer surface of the outer portion has a diameter between about fifty-eight percent (58%) and about sixty-seven percent (67%) of the maximum diameter at all distances from the distal end along the central axis equal to or less than about twenty percent (20%) of the maximum diameter.

5. The elastomeric component of claim 1, wherein the outer surface of the outer portion has a diameter between about sixty-seven percent (67%) and about eighty-eight percent (88%) of the maximum diameter at all distances from the distal end along the central axis greater than about twenty percent (20%) of the maximum diameter and less than about thirty percent (30%) of the maximum outside diameter.

6. The elastomeric component of claim 1, wherein the outer surface of the outer portion has a cross-sectional shape in a plane comprising the central axis of the elastomeric component, the cross-sectional shape including a concave portion and a convex portion located distally from the concave portion, wherein the concave portion extends through all distances from the distal end along the central axis greater than about twenty percent (20%) of the maximum diameter and less than about thirty percent (30%) of the maximum outside diameter.

7. The elastomeric component of claim 6, wherein the maximum diameter of the outer surface of the outer portion is located in the convex portion.

8. The elastomeric component of claim 1, wherein the elastomer component comprises a material having a Shore A durometer hardness of about 40.

9. The elastomeric component of claim 1, wherein the elastomer component comprises a silicone rubber material.

10. The elastomeric component of claim 1, wherein the at least substantially hollow stem region has a circular cross-sectional shape in a plane perpendicular to the central axis of the elastomeric component when the elastomeric component is not mounted to an earbud headphone.

11. An earbud headphone, comprising:

a main body; and an elastomeric component carried on the main body, the elastomeric component configured for positioning within an auditory canal of an ear, the elastomeric component removably attached to a main body of the earbud headphone, the elastomeric component comprising: a distal end configured for insertion within an external portion of the auditory canal; an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein: the outer surface of the outer portion has a maximum diameter located a distance from the distal end along the central axis, the distance being between about fifty percent (50%) and about sixty percent (60%) of the maximum diameter;

the outer surface of the outer portion has a diameter equal to or less than about seventy percent (70%) of the maximum outside diameter at all distances from the distal end along the central axis equal to or less than about twenty percent (20%) of the maximum diameter; and the outer surface of the outer portion has a diameter equal to or less than about eighty-eight percent (88%) of the maximum outside diameter at all distances equal to or less than about thirty percent (30%) of the maximum outside diameter;

a distance $d_{OP}$ is equal to between 75% and 85% of the maximum outside diameter $OD_{max}$;

the elastomeric component comprises a material having a hardness of between 30 and 50 on the Shore type A durometer scale; and the outer portion is configured to facilitate retention of the elastomeric component in the auditory canal and wherein: at least a portion of the outer portion of the outer surface exhibits a root mean square ("RMS") surface roughness of 3 μm;

wherein the maximum diameter is between about 11.5 millimeters and about 12.5 millimeters.

12. An elastomeric component for use with an earbud headphone and for positioning within an auditory canal of an ear, the elastomeric component comprising:

a distal end configured for insertion within an external portion of the auditory canal; an at least substantially hollow stem region extending proximally from the distal end, the hollow stem including at least one connection feature configured to interface with another component of an earbud headphone to removably retain the elastomeric component thereon; and an outer portion extending proximally from the distal end and at least substantially surrounding at least a portion of the stem region, the outer portion including an outer surface having an at least substantially circular cross-sectional shape in a plane perpendicular to a central axis of the elastomeric component, and wherein:

the outer surface of the outer portion has a maximum diameter located a distance from the distal end along the central axis, the distance being between about fifty percent (50%) and about sixty percent (60%) of the maximum diameter; the outer surface of the outer portion has a diameter equal between about fifty-eight percent (58%) and about sixty-seven percent (67%) of the maximum outside diameter at all distances from the distal end along the central axis equal to or less than about twenty percent (20%) of the maximum diameter; the outer surface of the outer portion has a diameter equal to between about sixty-seven percent (67%) and about eighty-eight percent (88%) of the maximum outside diameter at all distances from the distal end along the central axis equal to between about twenty percent (20%) and about thirty percent (30%) of the maximum outside diameter; and the outer surface of the outer portion has a cross-sectional shape in a plane comprising the central axis of the elastomeric component, the cross-sectional shape including a concave portion and a convex portion located distally from the concave portion, wherein the concave portion extends through all distances from the distal end along the central axis greater than about twenty percent (20%) of the maximum diameter and less than about thirty percent (30%) of the maximum outside diameter;

a distance $d_{OP}$ is equal to between 75% and 85% of the maximum outside diameter $OD_{max}$;

the elastomeric component comprises a material having a hardness of between 30 and 50 on the Shore type A durometer scale; and the outer portion is configured to facilitate retention of the elastomeric component in the auditory canal and wherein:

at least a portion of the outer portion of the outer surface exhibits a root mean square ("RMS") surface roughness of 3 μm;

wherein the maximum diameter is between about 11.5 millimeters and about 12.5 millimeters.

13. The elastomeric component of claim 12, wherein the distance at which the maximum diameter is located from the distal end along the central axis of the elastomeric component is about fifty-four percent (54%) of the maximum diameter.

14. The elastomeric component of claim 13, wherein the elastomer component comprises a material having a Shore A durometer hardness of about 40.

* * * * *